US009773488B2

(12) United States Patent
Wolf

(10) Patent No.: US 9,773,488 B2
(45) Date of Patent: Sep. 26, 2017

(54) PICKUP ASSEMBLY FOR AN ELECTRICAL STRINGED MUSICAL INSTRUMENT

(71) Applicant: Rick Wolf, Kettering, OH (US)

(72) Inventor: Rick Wolf, Kettering, OH (US)

( * ) Notice: Subject to any disclaimer, the term of this patent is extended or adjusted under 35 U.S.C. 154(b) by 0 days.

(21) Appl. No.: 15/201,409

(22) Filed: Jul. 2, 2016

(65) Prior Publication Data

US 2016/0314775 A1 Oct. 27, 2016

Related U.S. Application Data

(63) Continuation-in-part of application No. 14/840,509, filed on Aug. 31, 2015, now Pat. No. 9,384,721, which is a continuation of application No. 13/950,400, filed on Jul. 25, 2013, now Pat. No. 9,147,387.

(51) Int. Cl.
*G10H 3/00* (2006.01)
*G10H 3/18* (2006.01)

(52) U.S. Cl.
CPC ..... *G10H 3/183* (2013.01); *G10H 3/181* (2013.01)

(58) Field of Classification Search
CPC .. G10H 3/181; G10H 3/183; G10H 2220/481; G10H 2220/505; G10H 2220/511; G10H 3/143; G10H 3/182; G10H 2220/515
See application file for complete search history.

(56) References Cited

U.S. PATENT DOCUMENTS

| | | | | |
|---|---|---|---|---|
| 2,145,490 | A * | 1/1939 | Miller | G10H 3/181 381/118 |
| 2,175,325 | A | 10/1939 | Sunshine | |
| 4,133,243 | A | 1/1979 | DiMarzio | |
| 4,220,069 | A | 9/1980 | Fender | |
| 4,320,681 | A | 3/1982 | Altilio | |
| 4,425,831 | A | 1/1984 | Lipman | |
| 4,433,603 | A | 2/1984 | Siminoff | |
| 4,442,749 | A | 4/1984 | DiMarzio et al. | |
| 4,854,210 | A * | 8/1989 | Palazzolo | G10H 3/181 84/726 |
| 4,872,386 | A | 10/1989 | Betticare | |
| 5,029,511 | A | 7/1991 | Rosendahl | |
| 5,168,117 | A | 12/1992 | Anderson | |
| 5,221,805 | A | 6/1993 | Lace | |
| 5,252,777 | A | 10/1993 | Allen | |
| 5,637,823 | A | 6/1997 | Dodge | |

(Continued)

*Primary Examiner* — Marlon Fletcher
(74) *Attorney, Agent, or Firm* — Thomas E. Lees, LLC

(57) ABSTRACT

A pickup for a musical instrument includes a first assembly, a housing, and a magnet. The first assembly comprises a base plate, a pole that extends from the base plate, and a coil of wire wrapped around the pole. A first lead wire extends from a first coil end and a second lead wire extends from a second coil end. The housing is user attachable to, and detachable from, the top of the first assembly, independently of any electrical connections made to electronics of the musical instrument. Moreover, the housing attaches to and detaches from the first assembly such that when attached, the pole of the first assembly is in magnetic cooperation with the magnet. Also, the housing is removable, thus allowing the magnet to be changed out to another magnet without removing strings or other hardware of the musical instrument.

19 Claims, 16 Drawing Sheets

(56) References Cited

U.S. PATENT DOCUMENTS

| | | | | |
|---|---|---|---|---|
| 5,811,710 | A * | 9/1998 | Blucher | G10H 3/181 84/728 |
| 5,894,101 | A * | 4/1999 | Damm | G10H 3/181 84/723 |
| 5,949,014 | A | 9/1999 | Rashak et al. | |
| 6,103,966 | A | 8/2000 | Kinman | |
| 6,111,184 | A | 8/2000 | Cloud et al. | |
| 6,253,654 | B1 | 7/2001 | Mercurio | |
| 6,291,759 | B1 | 9/2001 | Turner | |
| 6,372,976 | B2 | 4/2002 | Damm | |
| 8,178,774 | B2 | 5/2012 | Salehi | |
| 8,415,551 | B1 | 4/2013 | Dixon | |
| 8,853,517 | B1 | 10/2014 | Dixon | |
| 8,907,199 | B1 | 12/2014 | Dixon | |
| 9,147,387 | B2 | 9/2015 | Wolf et al. | |
| 2002/0083819 | A1 | 7/2002 | Kinman | |
| 2005/0162247 | A1 | 7/2005 | Beller | |
| 2006/0156911 | A1 | 7/2006 | Stich | |
| 2012/0103170 | A1* | 5/2012 | Kinman | G10H 3/181 84/726 |
| 2012/0210847 | A1 | 8/2012 | Adair et al. | |
| 2012/0210848 | A1 | 8/2012 | Yamanaka | |
| 2013/0327202 | A1 | 12/2013 | Mills | |
| 2014/0245877 | A1 | 9/2014 | Gelvin | |
| 2015/0027300 | A1* | 1/2015 | Wolf | G10H 3/181 84/726 |
| 2015/0053069 | A1* | 2/2015 | Heil | G10H 3/181 84/726 |
| 2015/0199949 | A1 | 7/2015 | Fishman et al. | |
| 2016/0314775 | A1* | 10/2016 | Wolf | G10H 3/181 |

* cited by examiner

PICKUP ASSEMBLY FOR AN ELECTRICAL STRINGED MUSICAL INSTRUMENT

CROSS REFERENCE TO RELATED APPLICATIONS

This application is a continuation-in-part of U.S. patent application Ser. No. 14/840,509, filed Aug. 31, 2015, now allowed, entitled "PICKUP ASSEMBLY FOR AN ELECTRICAL STRINGED MUSICAL INSTRUMENT", which is a continuation of U.S. patent application Ser. No. 13/950,400, filed on Jul. 25, 2013, issued as U.S. Pat. No. 9,147,387 on Sep. 29, 2015, entitled "PICKUP ASSEMBLY FOR AN ELECTRICAL STRINGED MUSICAL INSTRUMENT", the disclosures of which are hereby incorporated herein by reference.

BACKGROUND

The present disclosure relates in general to a pickup for a stringed musical instrument, and more particularly to a pickup assembly for a stringed musical instrument that allows for the convenient and ready change and/or adjustment of the electrical characteristics of the pickup.

A typical electrical, stringed musical instrument such as an electric guitar or electric bass includes body, a neck extending from the body, and a headstock situated at the end of the neck. A set of strings span between a bridge located on the body and a nut located on the neck adjacent to the headstock. When strummed, plucked, picked or otherwise stroked, the strings vibrate producing sound. However, the acoustical output of the vibrating strings may not be loud enough for an intended application. As such, the instrument typically includes one or more electromagnetic pickups. The pickups convert the vibration of the strings into a representative electrical signal that can be coupled to an amplifier to produce an appropriate level of sound from the instrument.

BRIEF SUMMARY

According to aspects of the present disclosure, a pickup for an electrical, stringed musical instrument, comprises a first assembly, a magnet that is positioned on top of the first assembly, and a housing seated over the magnet.

The first assembly comprises a base plate, a pole that extends from the base plate, and a coil of wire having a first coil end and a second coil end, where the coil of wire is wrapped around the pole above the base plate. Yet further, the first assembly comprises a first lead wire that is attached to the first coil end and a second lead wire that is attached to the second coil end. The housing is user attachable to, and detachable from, the first assembly independently of any electrical connections made by the first lead wire and the second lead wire to electronics of the electrical, stringed musical instrument. Yet further, the magnet is seated in cooperation with the housing and the first assembly, e.g., between the housing and a top of the first assembly.

Given this configuration, the housing attaches to and detaches from the first assembly such that when attached, the pole of the first assembly is in magnetic cooperation with the magnet. Also, the housing and magnet are removable from the first assembly without removing the first assembly from the electrical, stringed musical instrument. Yet further, the housing and magnet are removable from the first assembly without removing strings or other hardware of the electrical, stringed musical instrument. Thus, the magnet can be swapped out with another magnet without taking apart the instrument and without removing the entire pickup from the stringed musical instrument.

According to further aspects of the present disclosure, a method of assembling a pickup for an electrical, stringed musical instrument, is provided. The method comprises constructing a first assembly by providing a base plate, assembling a pole to the base plate such that the pole extends outward from a face of the base plate, and wrapping a coil of wire having a first coil end and a second coil end around the pole, such that when the pole is assembled to the base plate, the coil of wire is above the base plate. The method also comprises attaching a first lead wire to the first coil end, and attaching a second lead wire to the second coil end. The method also comprises constructing a second assembly by forming a housing. Yet further, the method comprises positioning the magnet over the first assembly such that the pole of the first assembly is in magnetic cooperation with the magnet. Still further, the method comprises attaching the housing of the second assembly to the top of the first assembly so that the magnet is positioned there between.

As such, the housing can be user-attached and user-detached from the first assembly, thus exposing the magnet for a changeover to a different magnet independently of any electrical connections made by the first lead wire and the second lead wire. Moreover, the second assembly attaches to and detaches from the first assembly such that the housing and magnet are removable from the first assembly without removing the first assembly from the electrical, stringed musical instrument, and the housing and magnet are removable from the first assembly without removing strings or other hardware of the electrical, stringed musical instrument.

DETAILED DESCRIPTION

According to various aspects of the present disclosure, a pickup for an electrical, stringed musical instrument includes a changeable magnet assembly. The changeable magnet assembly facilitates changing the magnetic properties of the pickup without disturbing the electrical wiring of the pickup to other electronics in a corresponding instrument. For instance, the properties of the pickup installed in an instrument can be altered by exchanging a first changeable magnet assembly with a second changeable magnet assembly, where the second changeable magnet assembly includes a magnet having different properties compared to the magnet of the first changeable magnet assembly. Changing the magnet can result in moderate to significant changes to the response, output, harmonics and sound of the pickup in an instrument. Moreover, the changeover may be implemented without disconnecting any electrical wiring of the pickup to the instrument. That is, the changeover can optionally be accomplished without removing the first assembly from an instrument to which the pickup is installed.

According to further aspects of the present disclosure, a pickup for an electrical, stringed musical instrument is provided, which includes an adjustable magnet assembly that allows user adjustment of the magnet position within the pickup relative to a pole of the pickup. The ability to adjust the magnet position relative to the pole position allows a user to make "on-the-fly" adjustments to the performance of the pickup. As such, pickups are provided herein, that allow for the convenient and ready change and/or adjustment of the electrical characteristics of the pickup by providing for the changeover and/or adjustment of the relationship between a pole and a magnet of the pickup, as will be described in greater detail herein.

Still further, the nature of the construction of the disclosed pickups facilitates fast and efficient construction and assembly, making the pickups herein suitable for large volume production with reduced cost and reduced parts compared to conventional pickup designs.

Two-Assembly Pickup Construction

Figure 1:
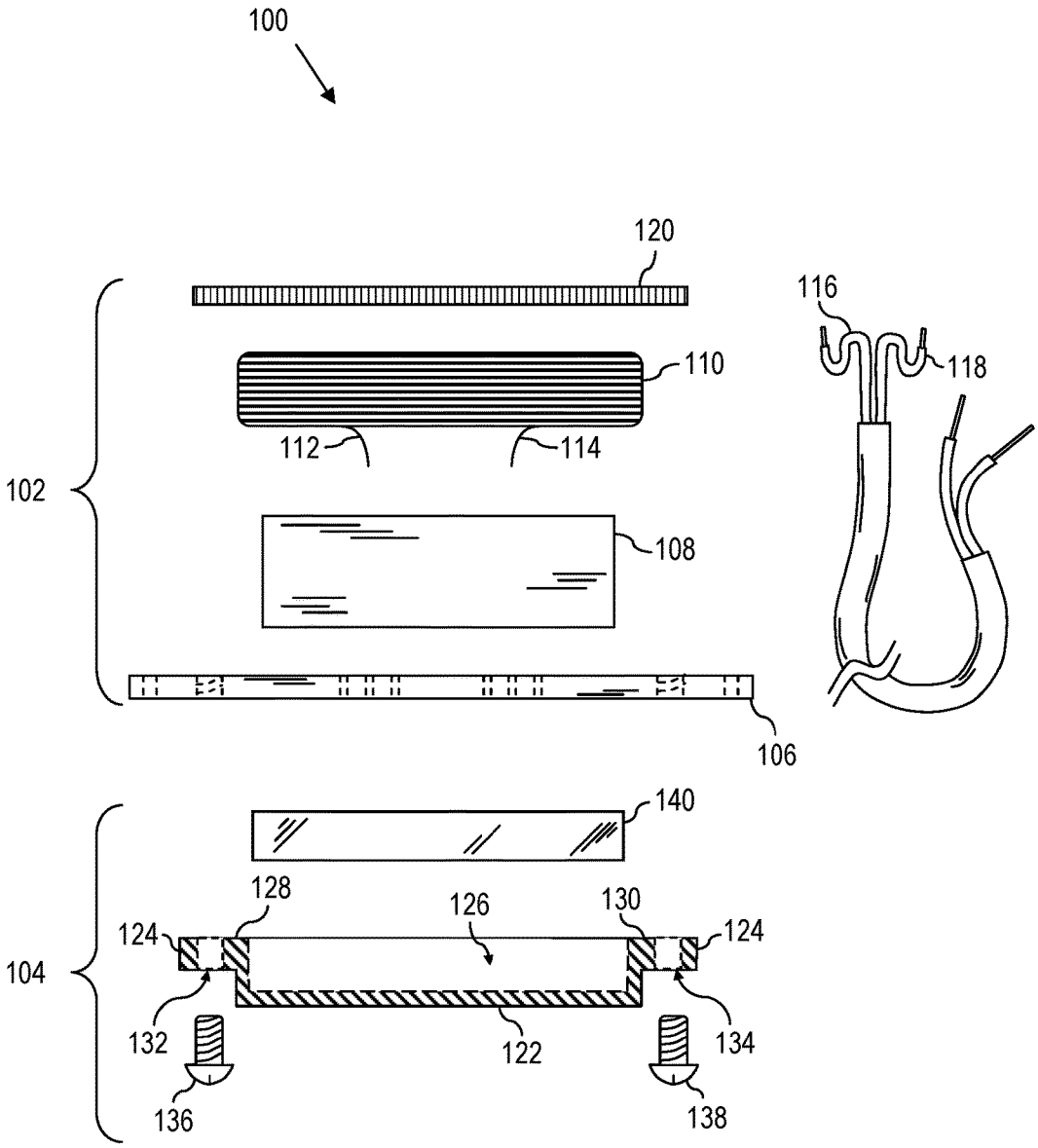
FIG. 1 is an exploded view of a pickup construction according to aspects of the present disclosure.

Referring now to the drawings and in particular to FIG. 1, an exploded view illustrates the parts of a pickup 100 for an electrical, stringed musical instrument, according to certain aspects of the present disclosure. The pickup 100 is an electromagnetic device that includes in general, a first assembly 102 and a second assembly 104. As will be described in greater detail herein, the first assembly 102 includes all of the electrical components of the pickup 100, whereas the second assembly 104 includes the magnet component(s) of the pickup 100.

The first assembly 102 includes a base plate 106 and a pole 108 that extends upward from the base plate 106. The first assembly 102 also includes a coil of wire 110 having a first coil end 112 and a second coil end 114, where the coil of wire 110 is wrapped around the pole 108, e.g., above the base plate 106. A first lead wire 116 is attached to the first coil end 112. Similarly, a second lead wire 118 is attached to the second coil end 114.

The first assembly 102 may also optionally include a top plate 120. In this regard, the coil of wire 110 is sandwiched between the base plate 106 and the top plate 120. Also, the pole 108 is seated within the coil of wire 110 and may extend up to or through the top plate 120. Additionally or alternatively, a pickup cover (not shown) or other features may be provided.

The second assembly 104 includes a housing 122 that includes a fastening feature 124 that allows the second assembly 104 to be user attachable to the first assembly 102 and user detachable from the first assembly 102. For instance, as illustrated, the housing 122 includes a magnet well 126. In this regard, the fastening feature 124 is implemented by a pair of flanges including a first flange 128 extending from a first end of the magnet well 126 and a second flange 130 extending from an end of the magnet well 126 opposite the first flange 128. Thus, the first flange 128 and the second flange 130 flank either side of the magnet well 126.

The first flange 128 includes a first aperture 132 therethrough. Analogously, the second flange 130 includes a second aperture 134 therethrough. A first fastener 136, e.g., a bolt passes through the first aperture 132 and is threadably received in the base plate 106 of the first assembly 102. Similarly, a second fastener 138, e.g., a bolt, passes through the second aperture 134 and is threadably received in the base plate 106 of the first assembly 102. For instance, threaded holes may be machined into the base plate 106 to align with the first aperture 132 and the second aperture 134. As another example, threaded inserts can be press fit into apertures extending through the base plate 106. Thus, the first fastener 136 and the second fastener 138 can be used to removably attach the housing 122 of the second assembly 104 to the base plate 106 of the first assembly 102.

This allows for instance, the ability of a user to remove an existing second assembly 104 from a given first assembly 102, and to install a new instance of a second assembly 104 (e.g., with different magnetic properties), simply and easily with common and conventional tools. Moreover, the electrical components are contained to the first assembly 102. For instance, the first lead wire 116 and the second lead wire 118, are attached to the first assembly 102 and extend from a side thereof, such that the first lead wire 116 and the second lead wire 118 do not need to be electrically disconnected from the pickup or other electronics within a corresponding instrument in order for the second assembly 104 to be swapped out. Thus, the properties of the pickup 100 can be changed without de-soldering the wiring to the other electronics of the instrument. Thus, the first assembly 102 is independent from the second assembly 104, allowing instances of the first assembly 102 to be freely mixed and matched with instances of the second assembly 104.

According to alternative aspects of the present disclosure, the second assembly 104 need not be user removable from the first assembly 102 once assembled. Such may be desirable in a manufacturing environment where the two-component approach herein is implemented to ease manufacturing and to reduce cost to manufacture.

According to still further alternative aspects of the present disclosure, the second assembly 104 need not be user removable from the first assembly 102 where the second assembly 104 is made user-adjustable relative to the first assembly 102, examples of which are described more fully herein.

As noted above, the second assembly 104 attaches and detaches from the first assembly 102 independently of any electrical connections made by the first lead wire 116 and the second lead wire 118. This allows the first assembly 102 and the second assembly 104 to be separately manufactured. Moreover, the above-structure allows the first assembly 102 to be coupled to the second assembly 104 any time before, during, or after the first assembly 102 of the pickup 100 has been installed in an instrument. For instance, where the pickup 100 attaches to a pick guard of an instrument (not shown), the second assembly 104 can be connected to the first assembly 102 even after the first assembly 102 is installed in the pick guard.

Although illustrated as using fasteners, e.g., bolts, the first assembly 102 can attach and detach from the second assembly 104 using other approaches, e.g., bands, clips, snaps, hook and loop fastener, magnets, etc. In certain embodiments, any approach may be utilized so long as the first assembly 102 can be user connected and separated from the second assembly 104.

A magnet 140 is seated within the housing 122. For instance, in the illustrative implementation, the magnet 140 seats in the magnet well 126. The magnet 140 can be potted, glued, or otherwise secured within the magnet well 126. Moreover, other structures may be included in the magnet well 126, such as a shim, a plate, a spacer, a well cover, etc.

The magnet 140 cooperates with the pole 108 to create a magnetic field about the pickup 100. In this regard, the second assembly 104 attaches and detaches to the first assembly 102 such that when attached, the pole 108 of the first assembly 102 is in magnetic cooperation with the magnet 140 of the second assembly 104.

When the pickup 100 is installed in a corresponding electrical stringed musical instrument, the pole 108 sits beneath the strings. The pole 108, in cooperation with the magnet 140 shapes a magnetic field that surrounds the pickup 100. The strings are composed of a magnetizable structure, e.g., metal such as steel, a magnetizable alloy or other structure that can interact with the magnetic field of the pickup 100. When the strings vibrate, the vibration of the string causes a corresponding change in the magnetic field about the pickup 100. This change in the magnetic field induces a corresponding electrical current in the coil of wire 110. That electrical current is output through a corresponding instrument and optional instrument electronics to an amplifier.

Example Pickup Component Configurations

The base plate 106 and the top plate 120 may be implemented as separate pieces, and thus define bobbin plates. In general, the base plate 106 and the top plate 120 may be any number of nonconductive materials, e.g., plastic, butyrate, a semi-rigid fibrous material, etc. Where the base plate 106 and the top plate 120 are implemented as separate pieces, the coil of wire 110 may wrap directly around the pole 108. Here, the top plate 120 sits over the base plate 106 such that the pole 108 extends through the top plate 120 and the coil of wire 110 is between the top plate 120 and the base plate 106.

Alternatively, the base plate 106 and the top plate 120 may be integral, e.g., implemented as a non-conductive bobbin that the coil of wire 110 wraps around. In this implementation, the pole 108 passes through the bobbin. Whether the base plate 106 and top plate 120 are separate pieces or a single bobbin depends upon the pickup style. For instance, many single coil designs do not use a bobbin. Comparatively, if the pickup 100 is being constructed as a "P-90" style or traditional "humbucker" style, then a bobbin is typically used, but is not required.

As used herein, the term "pole" 108 encompasses a single element, a combination of elements, an assembly of elements(s) and other structure(s), etc. As a few non-limiting but illustrative examples, the pole 108 may be constructed from a ferrous material (e.g., iron or steel being the most common), a ferromagnetic material, a magnetic material, an otherwise magnetizable material, or any other suitable material that contributes to the ability of the pickup to create a magnetic field or otherwise sense a change in the magnetic field.

Moreover, the pole 108 can be constructed in any suitable configuration. For instance, the pole 108 may be a blade, a set of individual slugs, a set of individual threaded pole pieces, any combination of blades, slugs and screws, etc. As used herein, the term "slug" with regard to the pole 108 includes a generally cylindrical shape, a cube or cuboid shape, a spherical shape, an irregular shape or other desired configuration that can cooperate with the magnet 140 to create a magnetic field about the pickup 100.

As a few illustrative examples, the pole 108 may comprise at least one blade (e.g., a generally cuboid shaped bar that is dimensioned to span all strings of a corresponding instrument to which the corresponding pickup is intended). The pole 108 may also be implemented as a set of slugs (e.g., one or more slugs dimensioned and spaced within the first assembly 102 to generally align under each string of a corresponding instrument). Still further, the pole 108 may be implemented as a set of slugs where one slug is dimensioned and spaced within the first assembly 102 to generally align under two or more strings of a corresponding instrument. The above-examples are non-limiting and other elements and configurations can be used as the pole 108.

As used herein, the term "magnet" 140 can in practice, be a single magnet, a combination of individual magnets, an assembly of magnet(s) and non-magnetic structure(s), etc. As a few non-limiting but illustrative examples, the magnet 140 may comprise a single magnet, e.g., a permanent magnet such as a ceramic magnet, a magnet of Alnico 2, a magnet of Alnico 5, or other magnet types. As a further example, the magnet 140 may be implemented as a set (e.g., one or more) of magnetic slug(s) where the slugs can be the same or different magnet type. As used herein, the term "slug" with regard to the magnet 140 includes a generally cylindrical shape, a cube or cuboid shape, a spherical shape, an irregular shape or other desired configuration that allows one or more magnets to be placed in the magnet well 126 or otherwise arranged such that the magnet well 126 holds the magnet 140. For instance, if the pole 108 is individual steel slugs, the magnet 140 can be a set of magnetic slugs, where one or more magnetic slugs align with each pole slug. Alternatively, one magnetic slug can align with one or more pole slugs, one pole slug can align with one or more magnet slugs, etc. As yet a further example, the magnet 140 can include non-magnetic structure(s) such as two individual magnets that sandwich a steel bar, a combination of one or more magnet(s) and one or more structure(s), etc.

The coil of wire 110 can in practice be a single continuous coated/insulated wire. Alternatively, the coil of wire 110 may be constructed from the series connection of one or more wire types. The wire is typically fine, e.g., on the order of 42 gauge or 43 gauge. However, any practical wire thickness (or thicknesses) can be used, depending upon the desired electrical properties of the pickup 100. Moreover, the wire can be constructed of any suitable material, e.g., copper, silver, gold, combinations thereof, etc. The number of turns of wire will depend upon the desired electrical characteristics of the pickup. However, typical pickups utilize several thousand turns of wire.

Once the first lead wire 116 and the second lead wire 118 are attached to the pickup 100, the pickup 100 can further be processed to secure the coil of wire 110. For instance, a length of wire (e.g., the same wire used to build the coil of wire 110) can optionally be wrapped around the coil of wire 110 so as to cover the entire coil, thus serving as a protective element. The wrapping of wire may also be utilized as a design element or for other decorative purposes. The coil of wire 110 can be protected by other and/or alternative protective elements as well. Examples of other protective elements include string, tape, cloth, etc.

The entire first assembly 102 of the pickup 100 may be "potted", so as to provide a potted treatment about the coil of wire. For instance, the pickup 100 may be treated in a melted mixture of paraffin, wax, chemical polymers or combinations thereof. This helps prevent microphonics in the pickup by preventing the wire in the coil of wire 110 from vibrating. In an illustrative implementation, the pickup is treated but is not vacuum chambered. Alternatively, the pickup 100 may be vacuum chambered.

Pickup Assembly

Figure 2:
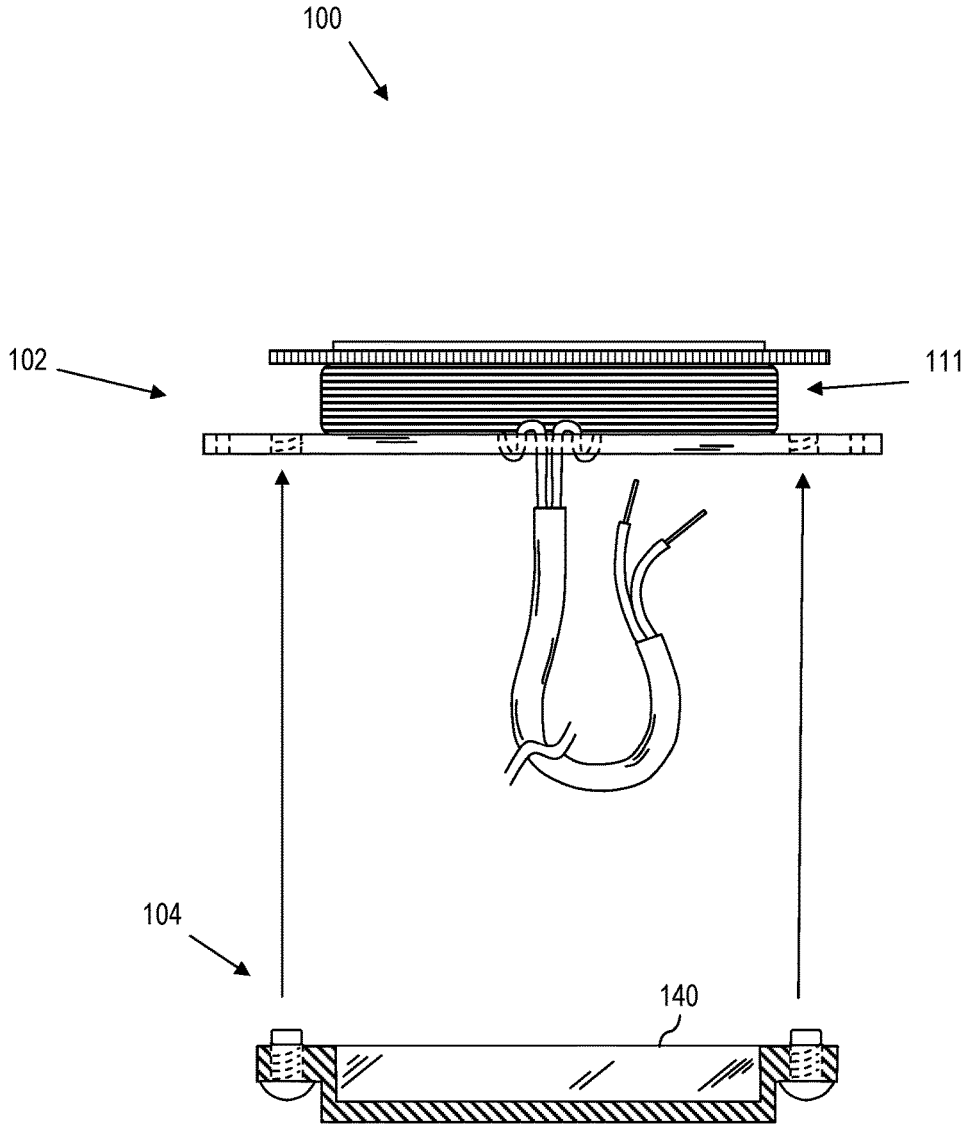
FIG. 2 is a side view of the pickup of FIG. 1 in a disassembled state, according to various aspects of the present disclosure.

Referring to FIG. 2, the pickup 100 of FIG. 1 is illustrated in a disassembled state. For instance, keeping with the above example, a user may have removed the two bolts that secure the second assembly 104 to the first assembly 102.

FIG. 2 also illustrates a wrapping 111 that is provided as an outer layer over the coil of wire. For instance, as noted above, the wrapping 111 can comprise a length of wire wrapped around the coil of wire 110. Alternatively, the wrapping 111 can be cloth, tape, etc.

Figure 3:
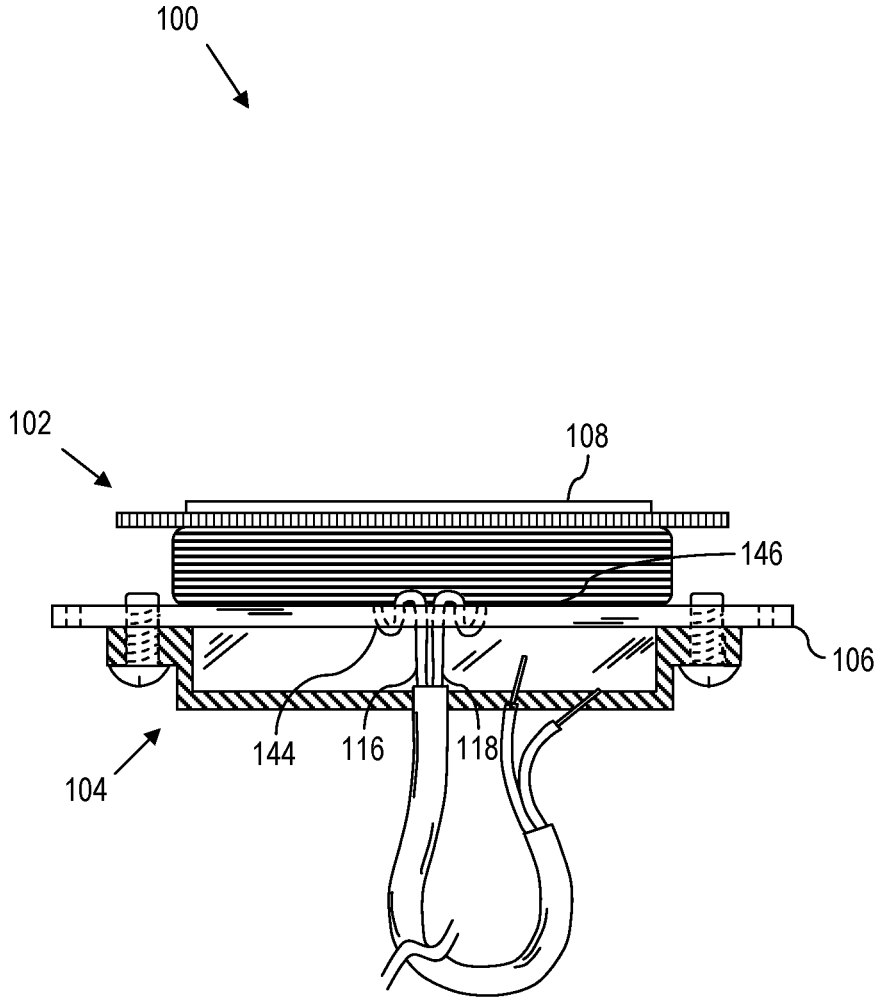
FIG. 3 is a side view of a pickup in an assembled state, according to various aspects of the present disclosure.

Referring to FIG. 3, the pickup 100 is illustrated in an assembled state where the second assembly 104 is secured to the first assembly 102. For instance, a user could screw the second assembly 104 to the first assembly 102 as described more fully herein.

As illustrated in FIG. 3, the base plate 106 further includes at least a first strain relief hole 144 and at least a second strain relief hole 146. For instance, as illustrated, there are a total of six strain relief holes (three holes per wire). The first lead wire 116 passes through the first strain relief hole 144. The first lead wire 116 may optionally snake up through an adjacent, second hole, then feed down a third hole. Similarly, the second lead wire 118 passes through the second strain relief hole 146. In an analogous manner, the second lead wire 118 may optionally snake up through an adjacent, second hole, then feed down a third hole. As such, any normal tugging on the first lead wire 116 and/or the second lead wire 118 will not cause strain on the connection of the lead wires to the corresponding coil wire ends.

Figure 4:
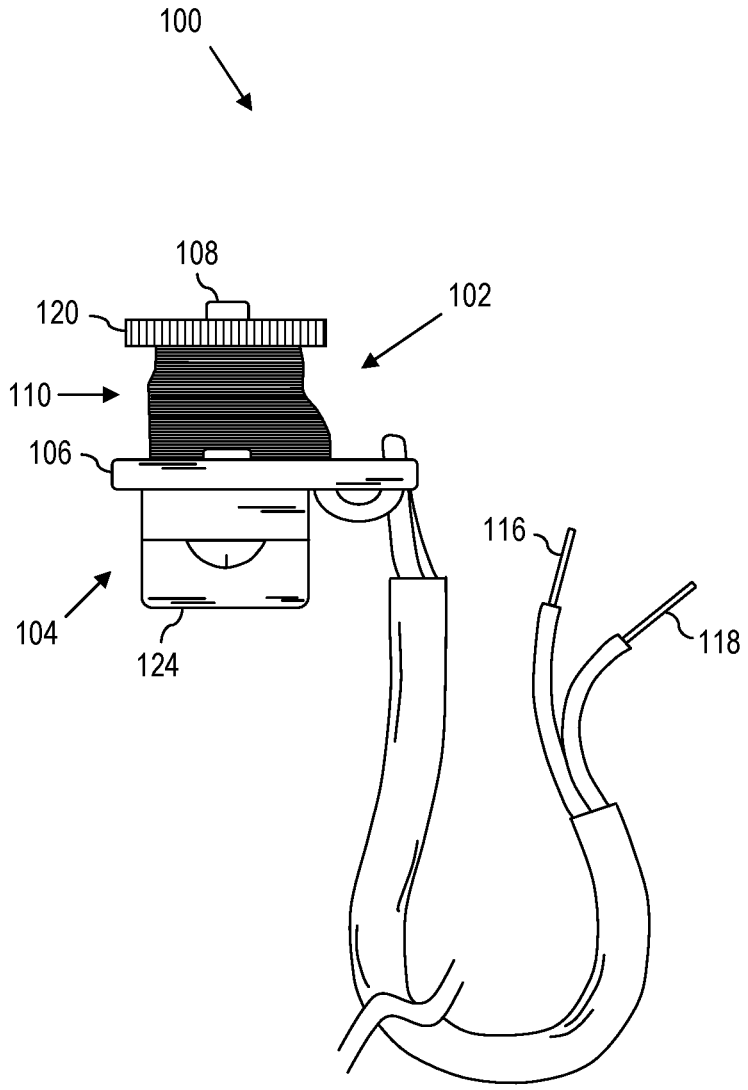
FIG. 4 is an end view of the pickup of FIG. 2.

Referring to FIG. 4, the pickup 100 of FIG. 1-FIG. 3 is illustrated in a side view to illustrate an embodiment where the base plate 106 of the first assembly 102 is wider than the housing 122 of the second assembly 104 to accommodate the strain relief for the first lead wire 116 and the second lead wire 118. In this illustrative implementation, the pole 108 extends from the top plate 120. However, in alternative implementations, the pole 108 can be flush with the top plate 120.

Figure 5:
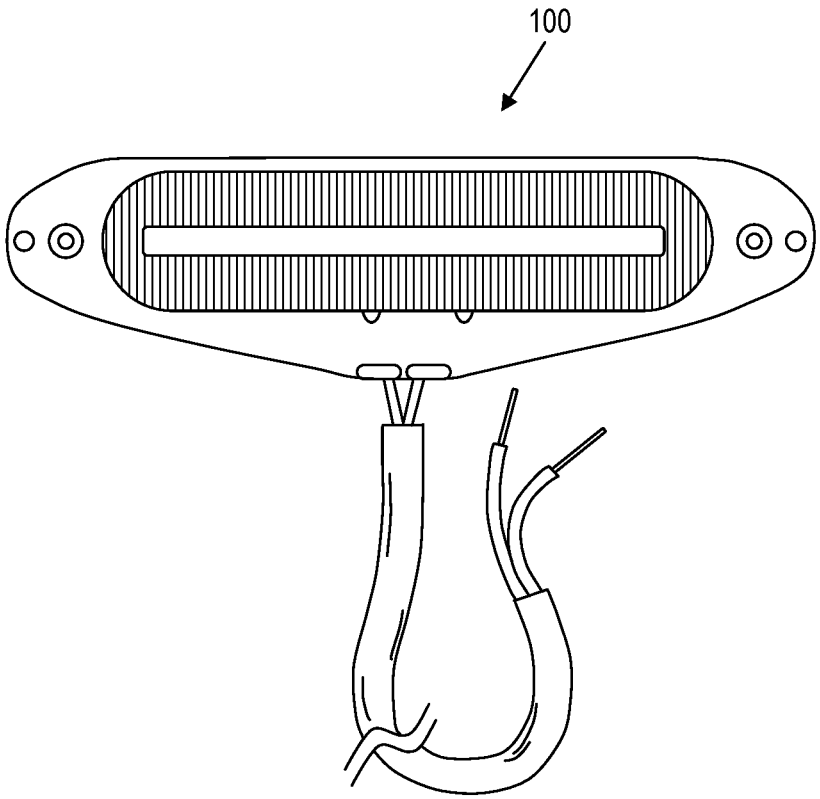
FIG. 5 is a top view of the pickup of FIG. 2.

Referring to FIG. 5, a top view of the pickup 100 (of FIGS. 1-4) is illustrated.

Adjustable Magnet Assembly

Referring to the FIGURES generally, the magnet 140 typically makes direct physical contact with the pole 108 (e.g., the blade or each slug, screw, etc.). However, such need not be the case. In this regard, adjustability of the magnet relative to the pole 108 can be used to further alter the electrical/magnetic properties of the pickup.

For instance, according to an illustrative implementation, the first assembly 102 further comprises a field-adjusting control that is user adjustable such that when the first assembly 102 is assembled with the second assembly 104, adjustment of the field adjusting control adjusts the distance of the magnet 140 from the pole 108. For instance, as will be described in greater detail below, the field-adjusting control includes a first threaded device that extends through the base plate 106 proximate to a first end and a second threaded device that extends through the base plate 106 proximate to a second end opposite the first end. In this regard, adjustment of the first threaded device selectively moves a first end of the magnet 140 relative to the pole 108 such that magnetic coupling remains. Likewise, adjustment of the second threaded device selectively moves a second end of the magnet 140 relative to the pole 108 such that magnetic coupling remains.

Figure 6:
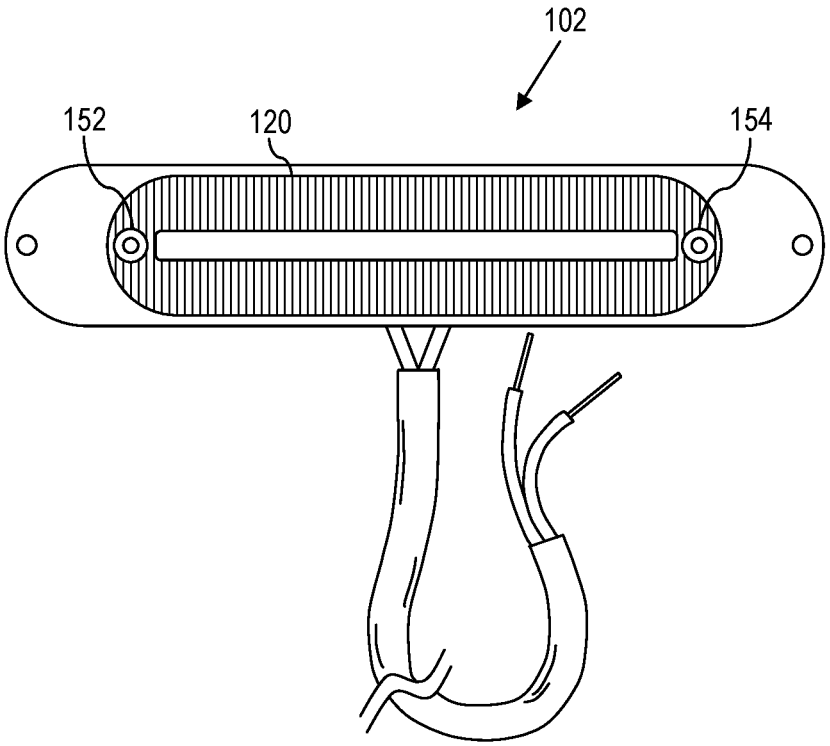
FIG. 6 is a top view of a pickup having a field adjusting control according to aspects of the present disclosure.

Referring to FIG. 6, a pickup 100 can include a field adjusting control according to an aspect of the present disclosure (alternative configurations are described later). As illustrated, the top plate 120 includes a pair of adjustment ports, including a first adjustment port 152 and a second adjustment port 154. The pickup of FIG. 6 also illustrates an embodiment where the base plate 106 of the first assembly 102 has dimensions that are similar to the dimensions of the housing 122 of the second assembly 104. Here, the strain relief for the first lead wire 116 and the second lead wire 118 is concealed by the top plate 120 when looking "top down" thus allowing a smaller pickup profile relative to the configuration illustrated in FIG. 5.

Figure 7:
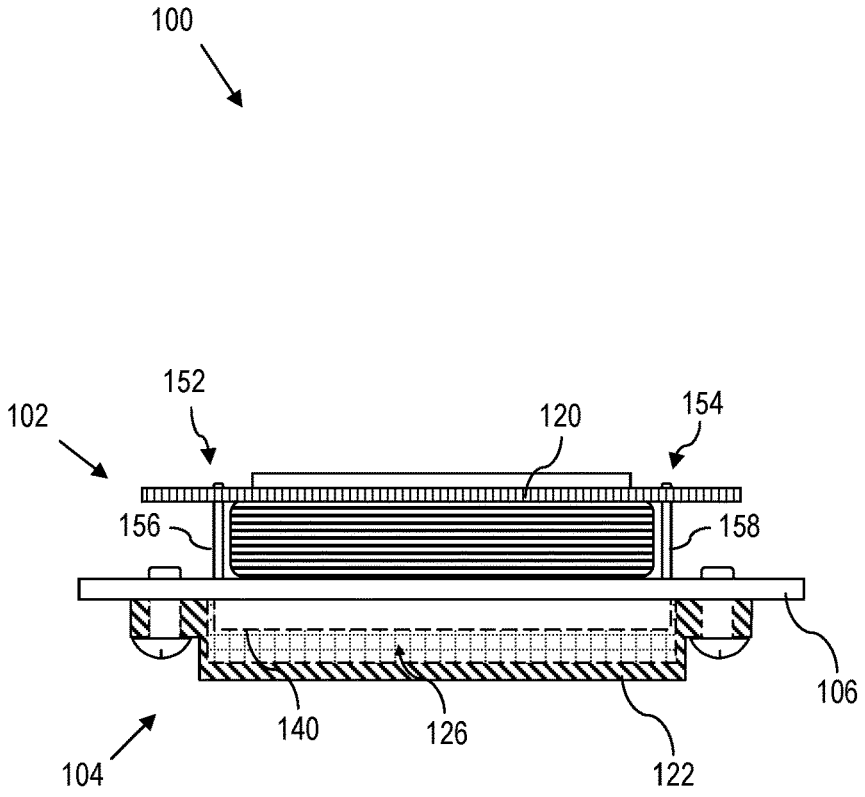
FIG. 7 is a side view of the pickup of FIG. 6 with a magnet in a first position according to aspects of the present disclosure.

Referring to FIG. 7, a first threaded device 156 passes through the first adjustment port 152 so as to extend through the top plate 120, the base plate 106 and into the magnet well 126 where the magnet 140 resides. Similarly, a second threaded device 158 passes through the second adjustment port 154 so as to extend through the top plate 120, the base plate 106 and into the magnet well 126 where the magnet 140 resides. For instance, as illustrated, the first threaded device 156 extends through the base plate 106 proximate to a first end thereof. Likewise, the second threaded device 158 extends through the base plate 106 proximate to a second end opposite the first end.

Normally, the magnet 140 is in intimate (i.e., direct physical) contact with the pole 108. Alternatively, the magnet 140 is within an extremely short proximity to the pole 108. However, the first threaded device 156 can be threaded downward so as to urge against a section of the magnet 140 as illustrated (in an alternative example, the first threaded device can urge against the magnet housing 122), thus moving at least a portion of the magnet 140 from intimate (i.e., direct physical) contact with the pole 108. Likewise, the second threaded device 158 can be threaded downward so as to urge against a section of the magnet 140 (or alternatively, the magnet housing 122) thus moving at least a portion of the magnet 140 from intimate (i.e., direct physical or otherwise close proximate) contact with the pole 108. This adjustability can be used to change for instance, the response of the pickup to achieve greater impact on the treble-side strings or bass-side strings of a corresponding instrument, depending upon how the field adjusting control is operated.

Figure 8:
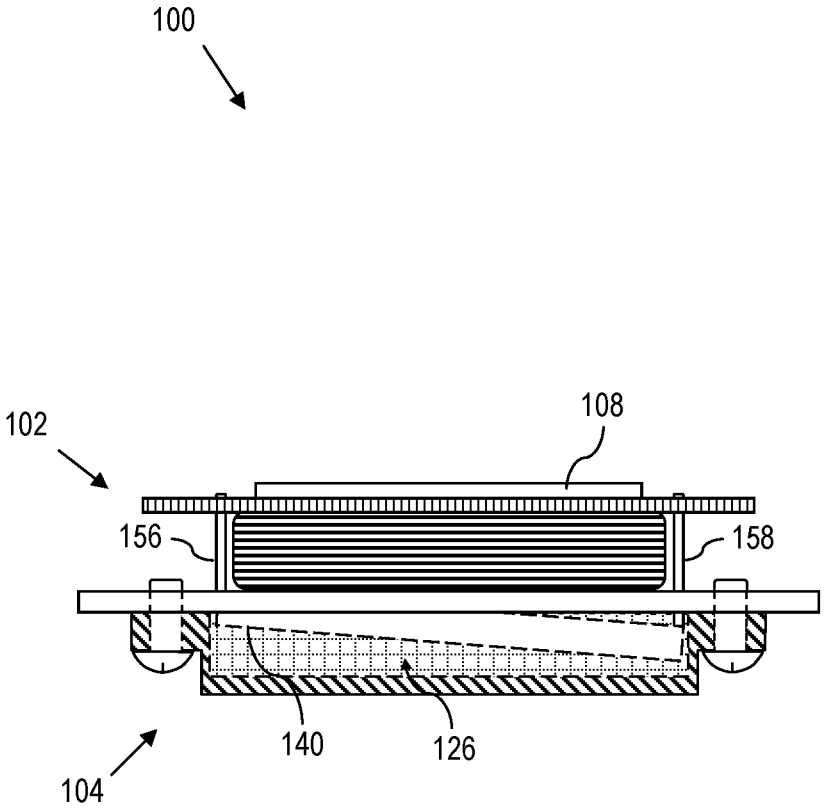
FIG. 8 is a side view of the pickup of FIG. 6 with the magnet adjusted to a second position according to aspects of the present disclosure.

Referring to FIG. 8, the magnet 140 has been adjusted such that a distance from the magnet 140 to the pole 108 is non-uniform across the length of the pole 108. For instance, as illustrated, the magnet 140 is angled downward relative to the pole 108 such that the right side (as seen in the FIGURE) of the magnet 140 is further from the pole 108 than the left side (as seen in the FIGURE) of the magnet.

Figure 9:
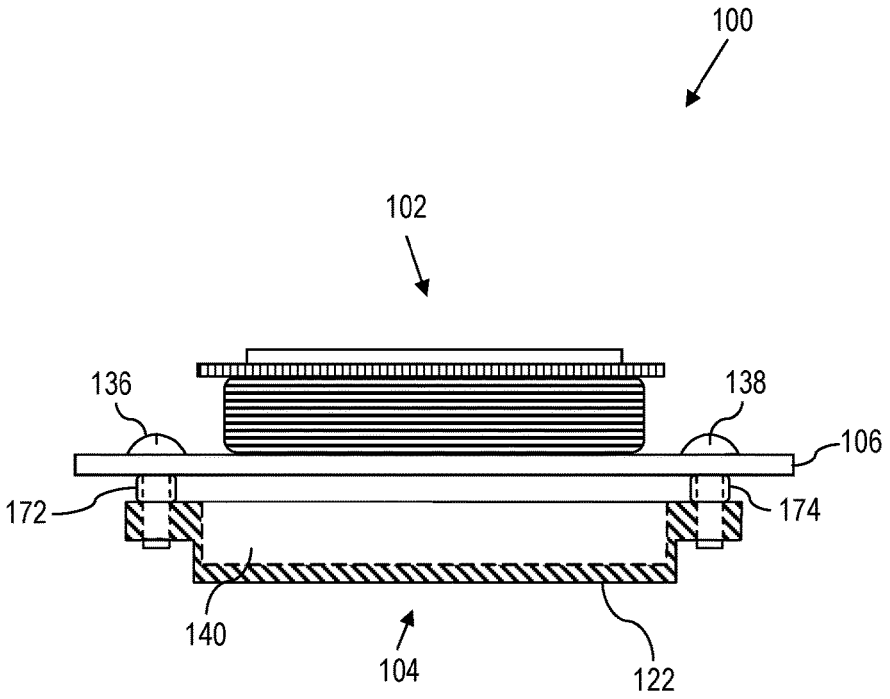
FIG. 9 is a side view of a pickup with an adjustable magnet housing in a first position according to further aspects of the present disclosure.

Referring to FIG. 9, an adjustable magnet assembly is illustrated according to still further aspects of the present disclosure. The pickup 100 is analogous the pickup 100 described in greater detail herein. However, in the illustrative example, the first fastener 136 and second fastener 138 (e.g., bolts) that are used to exchangeably secure the first assembly 102 to the second assembly 104 are "flipped" so that the bolt head is to the top of the base plate 106. Moreover, a spring is positioned between the first assembly 102 and the second assembly 104. This allows a user to adjust the position of the magnet housing 122 without disassembling the instrument or the pickup 100.

As illustrated, a first spring 172 (a first elastomeric sleeve) separates the base plate 106 of the first assembly 102 from the housing 122 of the second assembly 104 on a first side thereof. Likewise, a second spring 174 (a second elastomeric sleeve) separates the base plate 106 of the first assembly 102 from the housing 122 of the second assembly 104 on a second side opposite the first side. The springs 172, 174 can comprise an elastomeric structure, e.g., tube, sleeve etc. The springs 172, 174 may also comprise a wire spring, or other structure that serves as a spacer that can be compressed, contract or otherwise urges against the second assembly 104 as the associated bolt is tightened.

Figure 10:
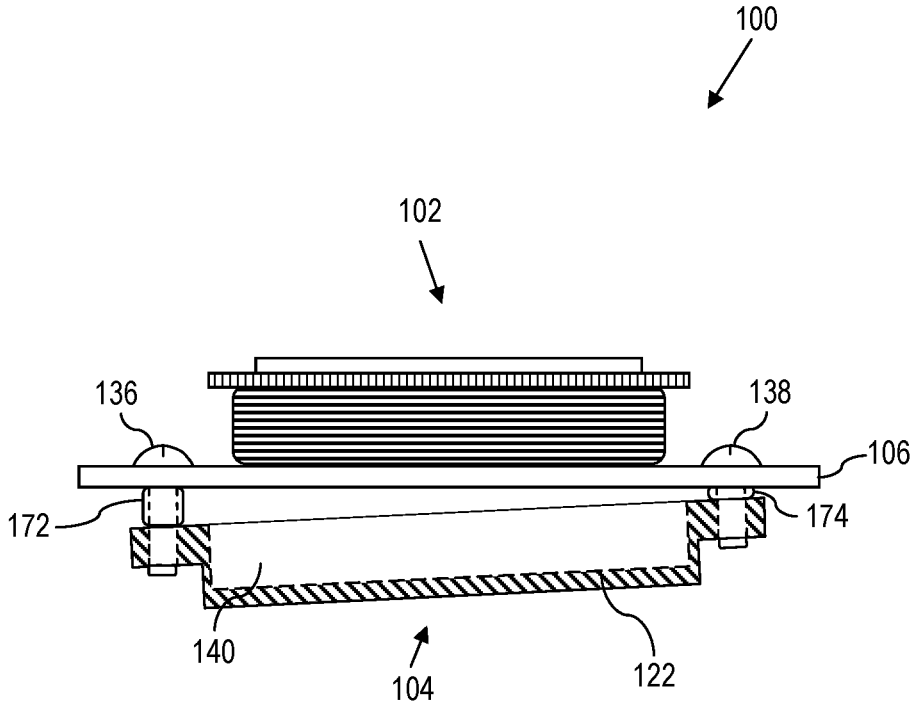
FIG. 10 is a side view of the pickup of FIG. 9 with the magnet housing adjusted to a second position different from the first position, according to further aspects of the present disclosure.

Referring to FIG. 10, the magnet housing 122 has been adjusted so as to be closer to the first assembly 102 seen to the right of the page, and correspondingly further away from the first assembly 102 seen to the left of the page. In this exemplary implementation, the magnet 140 does not move relative to the housing 122. Rather, the entire second assembly 104 moves relative to the first assembly 102.

Regardless of the particular adjustment embodiment, the adjustment of the first threaded device 156 selectively moves a first end of the magnet 140 (and/or magnet housing 122) from direct contact with the pole 108 to a spaced position from the pole 108 such that magnetic coupling remains. Likewise, the adjustment of the second threaded device 158 selectively moves a second end of the magnet 140, the housing 122, or both from direct contact with the pole 108 to a spaced position from the pole 108 such that magnetic coupling remains. By adjusting the distance of the magnet 140, the housing 122, or both from the pole 108, different sonic alterations can be achieved. The springs 172, 174 urge between the first and second assemblies 102, 104 to preserve the user-adjusted spacing.

Top Mounted Magnet

Figure 11:
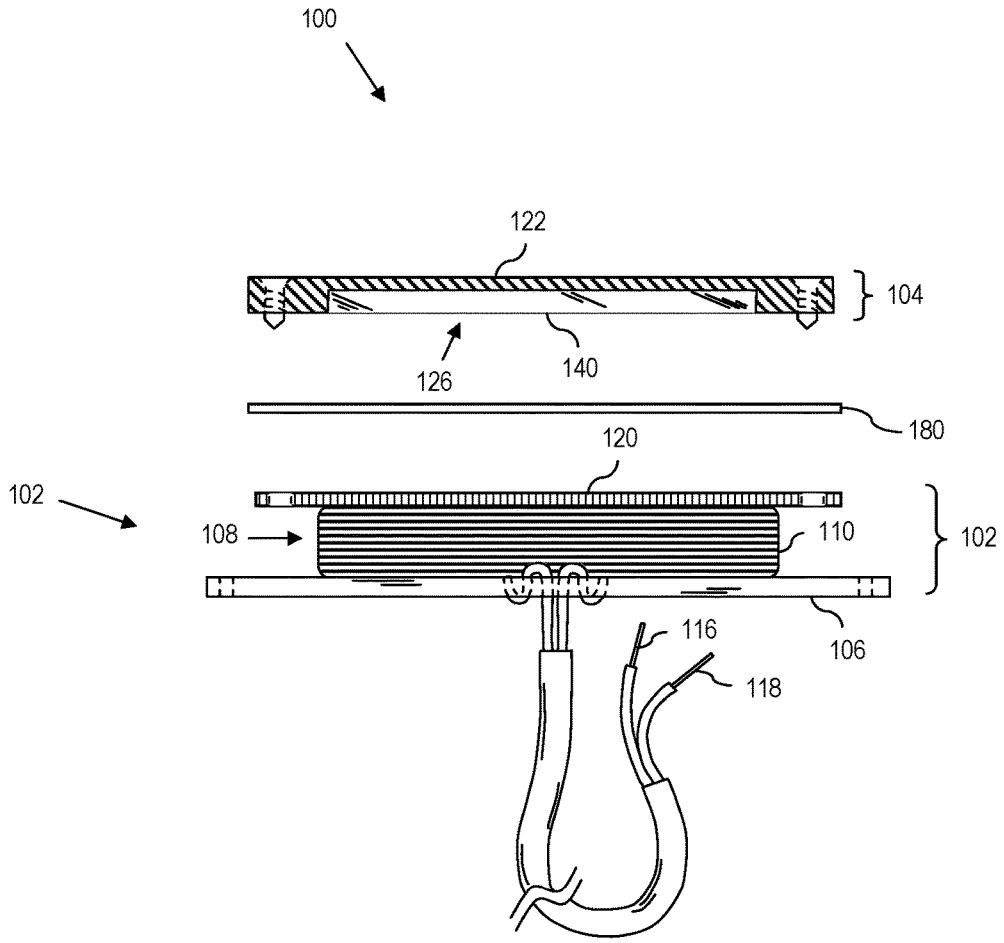
FIG. 11 is an exploded view of a pickup construction according to further aspects of the present disclosure, where the magnet is mounted to the top of the pole.

Referring to FIG. 11, in example implementations, the second assembly 104 is mounted on top of the first assembly 102. This allows changeover of the second assembly 104 and/or magnet without disturbing the electronics or hardware of the instrument to which the pickup is mounted. Moreover, there is no need to remove the entire pickup from the instrument in order to change the tonal qualities of the pickup via a magnet swap. Since the structures of FIG. 11 are largely analogous to those of FIG. 1, the description of FIGS. 1-10 herein is incorporated with reference to the structures of FIG. 11 unless otherwise noted.

The pickup 100 of FIG. 11 is intended for an electrical, stringed musical instrument. In this regard, the pickup 100 comprises a first assembly 102, which includes a base plate 106, a pole 108 that extends from the base plate 106, and a coil of wire 110 having a first coil end and a second coil end, where the coil of wire 110 is wrapped around the pole 108 above the base plate 106. In optional configurations, the first assembly 102 also includes a top plate 120.

In practical implementations, the base plate 106 can be used to couple the pickup 100 to an instrument body of the electrical, stringed musical instrument, e.g., by attaching the pickup 100 to a pickguard or directly to the body of the stringed musical instrument.

Where a top plate 120 is provided, the pole 108 can be mounted between the base plate 106 and the top plate 120. Moreover, the pole 108 can have any configuration set out throughout this disclosure, including those configurations described earlier with reference to FIGS. 1-10. By way of example, the pole 108 can comprise a blade, at least one slug, at least one individual threaded pole piece, and a combination thereof.

Likewise, the coil of wire 110 can have any configuration set out throughout this disclosure, including those configurations described earlier with reference to FIGS. 1-10. Also, as described more fully herein, first lead wire 116 attached to the first coil end, and a second lead wire 118 attached to the second coil end.

A second assembly 104 includes at least a housing 122. The housing 122 is user attachable to, and detachable from, the first assembly 102 independently of any electrical connections made by the first lead wire 116 and the second lead wire 118 to electronics of the electrical, stringed musical instrument. Moreover, a magnet 140 is seated in cooperation with the housing 122, e.g., between the housing 122 and the top of the first assembly 102.

In the illustrated example, the magnet 140 seats in a magnet well 126 of the housing 122. The magnet 140 can be glued, potted, press fit, snapped into, or otherwise seated and/or secured to the magnet well 126. The magnet 140 cooperates with the pole 108 to create a magnetic field about the pickup 100. In this regard, the second assembly 104 attaches and detaches to the first assembly 102 such that when attached, the pole 108 of the first assembly 102 is in magnetic cooperation with the magnet 140 of the second assembly 104.

Moreover, as described more fully herein, in practice, the magnet 140 can be a single magnet, a combination of individual magnets, an assembly of magnet(s) and non-magnetic structure(s), etc. As a few non-limiting but illustrative examples, the magnet 140 may comprise a single magnet, e.g., a permanent magnet such as a ceramic magnet, a magnet of Alnico 2, Alnico 5, Alnico 8, Neodymium, Samarium Cobalt, other magnet types or combinations thereof. As a further example, the magnet 140 may be implemented as a set (e.g., one or more) of magnetic slug(s) where the slugs can be the same or different magnet type. As yet a further example, the magnet 140 can include non-magnetic structure(s) such as two individual magnets that sandwich a steel bar, a combination of one or more magnet(s) and one or more structure(s), etc. Yet further, the magnet 140 can take on other forms/structures as set out more fully herein.

The second assembly 104 can also include other structures, such as a shim, a plate, a spacer, a well cover, etc. For instance, an optional non-magnetic spacer 180 can be provided between the magnet 140 and the first assembly 102. The non-magnetic spacer 180 is illustrated between the housing 122 and the top plate 120 of the first assembly 102. The non-magnet spacer 180 can comprise an isolator that prevents movement of the magnet and hence reduces microphonics of the pickup 100. The optional spacer 180 can also comprise a gel, foam or other structure that structurally/ physically isolates the magnet 140, yet does not significantly interfere with magnetic coupling of the magnet 140 to the pole 108.

The housing 122 attaches to and detaches from the first assembly 102 such that when attached, the pole 108 of the first assembly 102 is in magnetic cooperation with the magnet 140. Also, the housing 122 and magnet 140 are removable from the first assembly 102 without removing the first assembly 102 from the electrical, stringed musical instrument. Yet further, the housing 122 and magnet 140 are removable from the first assembly 102 without removing strings or other hardware of the electrical, stringed musical instrument.

Figure 12:
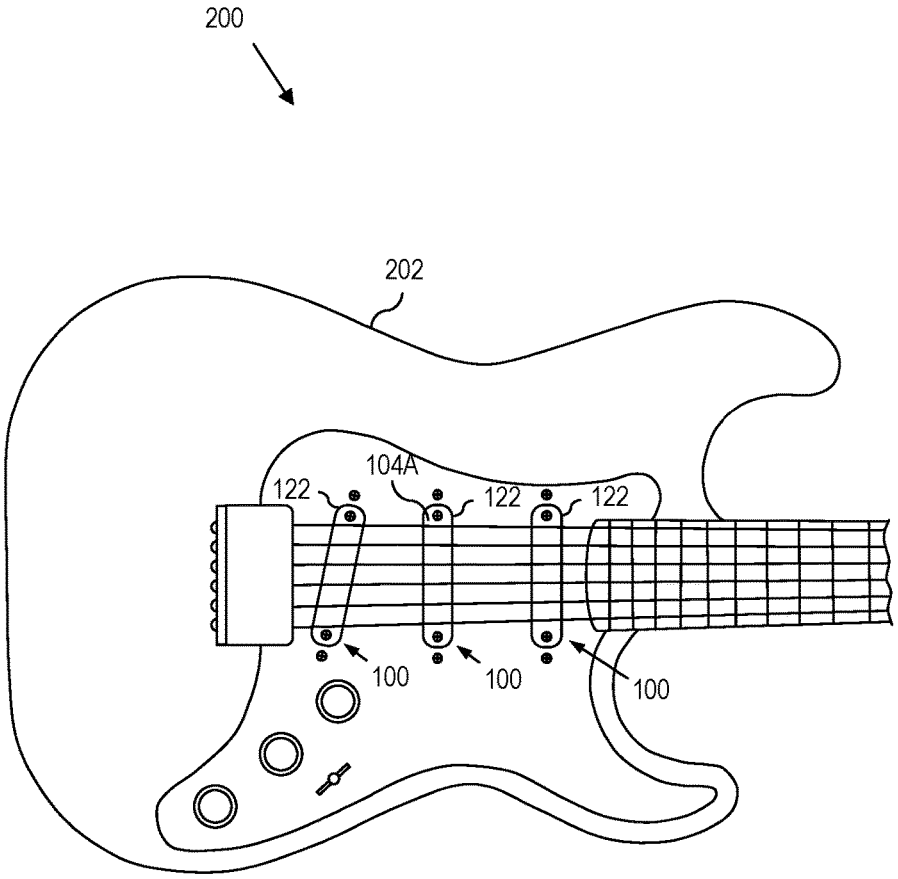
FIG. 12 illustrates three pickups of FIG. 11 mounted in an electrical, stringed musical instrument.

For instance, with reference to FIG. 12, a partial view of an electrical, stringed musical instrument 200 is illustrated. The electrical, stringed musical instrument 200 includes an instrument body 202 upon which three pickups 100 are mounted, e.g., by attaching to a pickguard, by attaching to a recess in the body covered by the pickguard, etc. Since the magnet 140 is on top of the pole 108 in this example, the housing 122 is visible underneath the strings of the electrical, stringed musical instrument.

With particular reference to the middle pickup 100, an example is given of a magnet changeover. As such, for the middle pickup, the second assembly is designated 104A to indicate a first magnet type is installed. In this example, the second assembly 104A includes the housing 122 and optional additional components, e.g., the magnet 140, etc.

Figure 13:
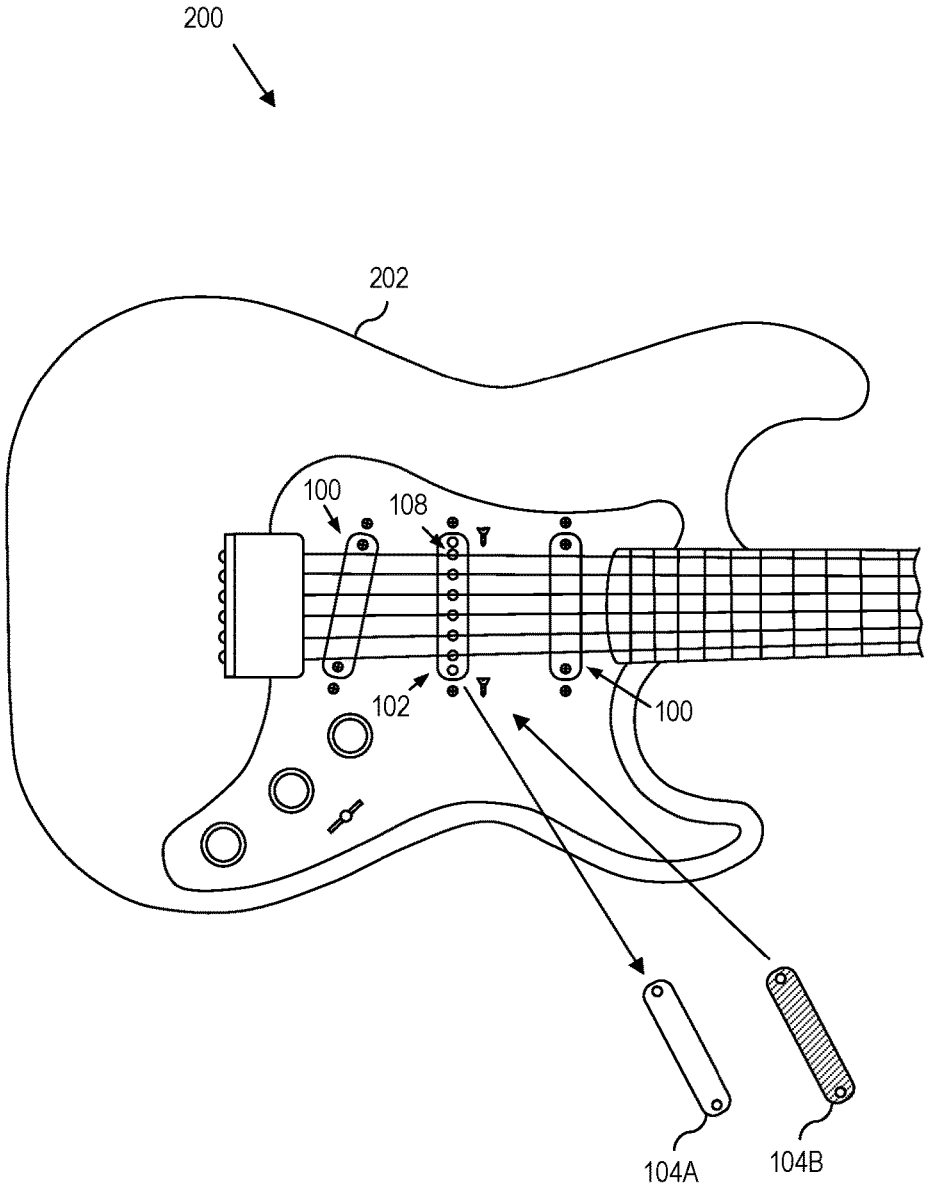
FIG. 13 illustrates the electrical, stringed musical instrument of FIG. 12, with the second housing removed from the middle pickup to expose the first assembly so that a magnet can be swapped out with a second magnet.

Referring to FIG. 13, in this example, a pair of screws used to temporarily secure the housing 122 to the first assembly 102 of the middle pickup are removed and the second assembly 104A is removed. In this example, the pole 108 of the first assembly 102 is now exposed (seen as six slugs that are flush with a top surface of the top plate 120. That is, the pole 108 is illustrated as six vertical (out of the page) columns as opposed to a bar-type pole piece. This example is solely for the sake of illustrating that the pole 108 can be implemented using various structures, including those set out more fully herein.

Also as illustrated in FIG. 13, a new second assembly 104B, having a housing that contains a different magnet therein, is slipped under the strings and into position over the first assembly 102. In an alternative configuration, one could replace the magnet 140 in the first assembly 104A with a magnet 140 with different properties, then re-install the same first assembly 104A.

Figure 14:
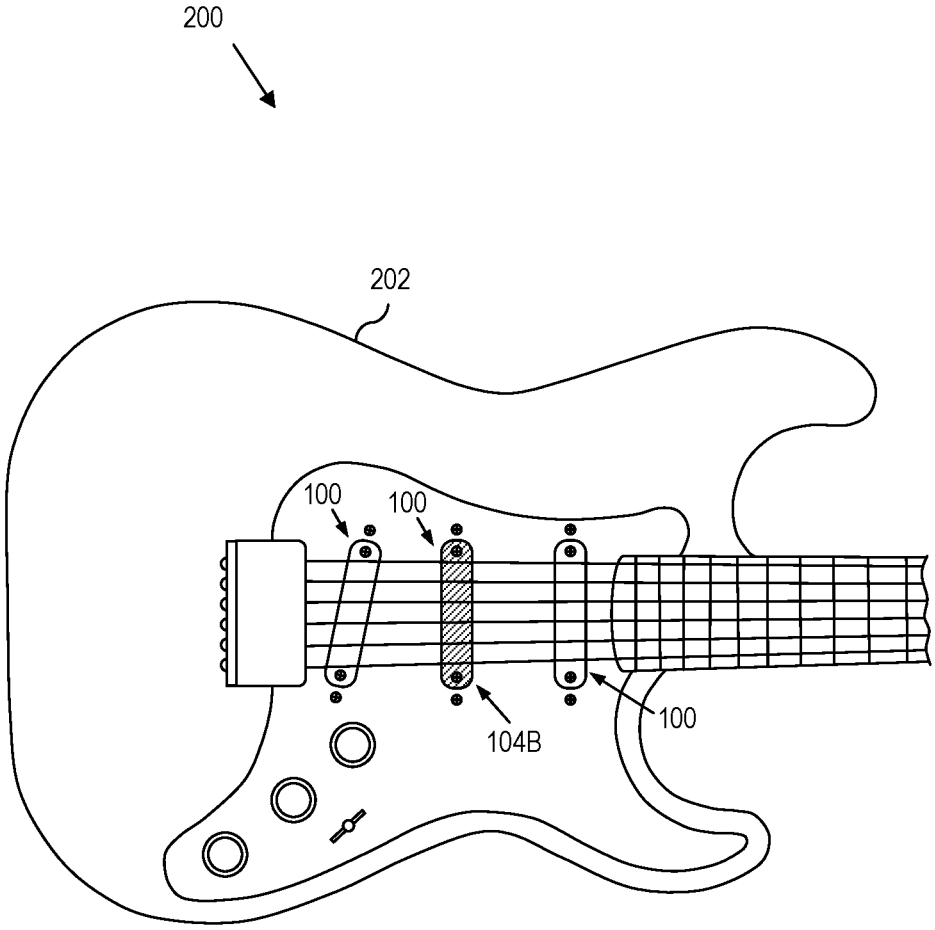
FIG. 14 illustrates the electrical, stringed musical instrument of FIG. 13 with a new magnet installed in the middle pickup.

Referring to FIG. 14, the new second assembly 104B is secured to the first assembly 102 to create a pickup 100 with new sonic properties. In this regard, changing the magnet 140 to a magnet with different properties will have a range from subtle to extreme changes in tone of the instrument.

Notably, this configuration allows the magnet to be changed quickly, without any adjustment to the electrical stringed musical instrument itself. By changing magnet types, e.g., from alnico 2, alnico 5, alnico 8, ceramic, neodymium, samarium cobalt, etc. the sound of the instrument can be quickly reconfigured, almost on the fly. For instance, when experimenting with different magnet types, the housing 122 need not be screwed into the first assembly 102. Rather, the strength of the magnet is sufficient to hold the housing to the first assembly 102.

Notably, the housing 122 can be temporarily held to the first assembly 102 via the magnet 140, via clips, hook and loop fastener, quick disconnects, snaps, threaded fasteners or other devices.

With reference back to FIG. 12, in example configurations, the housing 122 has a generally flat top surface and the magnet 140 sits in a well underneath the housing 122. Here, the housing is underneath the strings, and above the first assembly 102. (the base plate 108 of the first assembly 102 is typically mounted to the instrument body).

Referring back to FIG. 13, the first assembly is shown with a top plate that is configured such that the top surface of the pole 108 is even with, and exposed through the top surface of the top plate 120. The promotes strong coupling between the magnet 140 and the pole 108. In a particular example configuration, the pole 108 is secured between the base plate 106 and the top plate 120 of the first assembly 102 such that the pole 108 is flush with a top surface of the top plate 108, and the housing 122 is temporarily secured to the top plate 120 by at least one fastener such that the magnet 140 is in cooperation with the pole 108.

Figure 15:
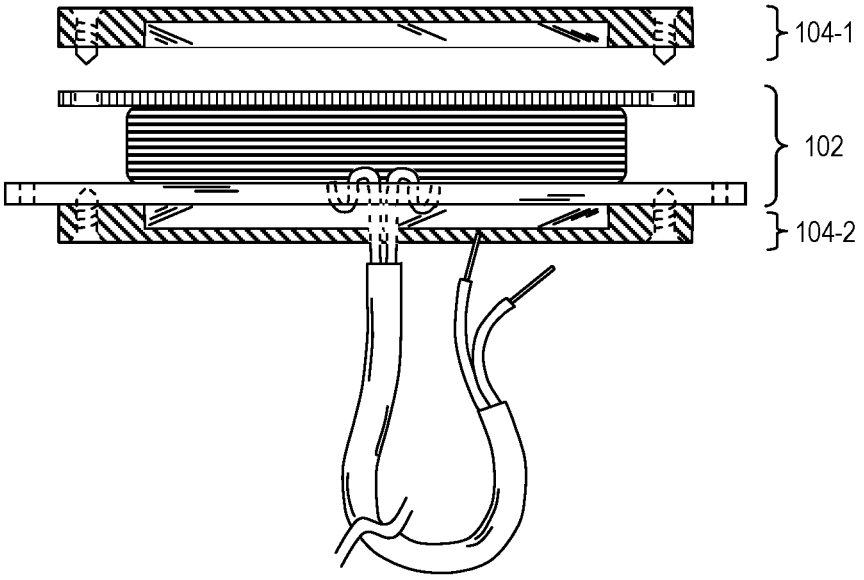
FIG. 15 illustrates a pickup according to yet further aspects of the present disclosure, which includes two magnets.

Referring to FIG. 15, in certain example embodiments, a second assembly 104-1 is situated over the top plate of the first assembly 102, and a third assembly 104-2 is situated under the bottom plate of the first assembly 102. This places two magnets in cooperation with the pole 108. The second assembly 104-1 and the third assembly 104-2 are analogous to the second assembly 104 described with reference to FIGS. 1-14.

For instance, in an example configuration, the pickup can comprise a first housing having a magnet well therein. A first magnet is secured within the magnet well of the first housing 122. The first housing secures to the top plate of the first assembly. The example pickup also includes a second housing having a magnet well therein, and a second magnet mounted in the magnet well of the second housing, wherein the second housing is attached to the first assembly opposite the first housing. The combination of magnets 140, and the positioning of the magnets 140 above and below the pole 108, when considered with the different types of magnet structures, examples of which are described more fully herein, allow the creation of varied and unique magnetic fields not otherwise possible with conventional pickups.

Figure 16:
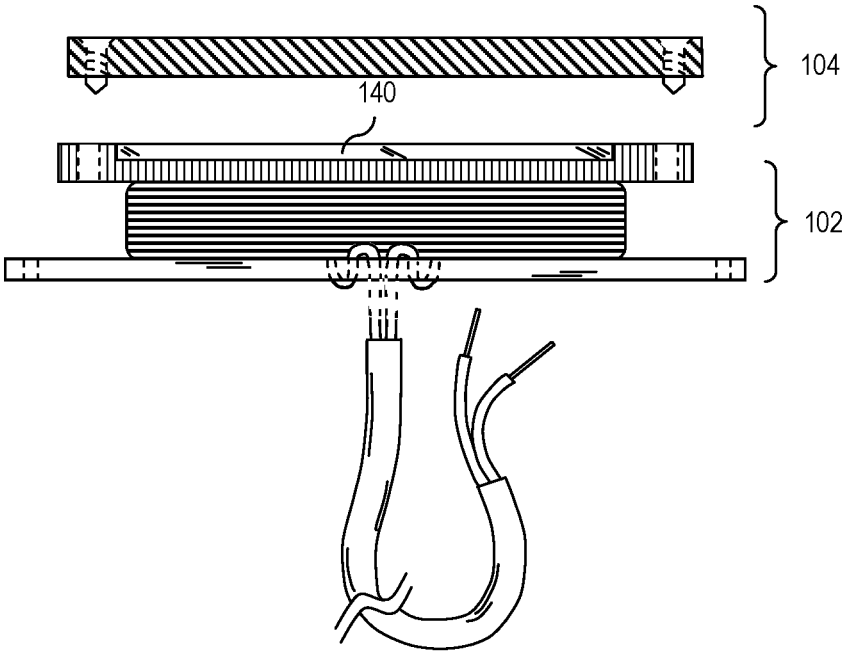
FIG. 16 illustrates a pickup according to still further aspects of the present disclosure where the magnet seats in a well in the first assembly.

Referring to FIG. 16, it is also possible to place the magnet well in the top plate of the first assembly 102 as opposed to being in the housing.

With reference to FIGS. 11-16, in certain illustrative embodiments, the housing 122 is user attachable directly to the first assembly 104 (e.g., via the screws as best illustrated in FIG. 13) such that the magnet 140 is situated between strings of the electrical, stringed musical instrument, and the pole 108 of the first assembly 102.

The pickup 100 of FIG. 11 can optionally include a field-adjusting control (as described more fully with reference to FIG. 7-10, that is user adjustable such that when the first assembly is assembled with the second assembly, adjustment of the field-adjusting control adjusts a distance of the magnet from the pole.

The field-adjusting control can comprise a first threaded device that extends into the first assembly proximate to a first end, and a second threaded device that extends into the first assembly proximate to a second end opposite the first end. Here, the adjustment of the first threaded device selectively moves a first end of the magnet relative to the pole such that magnetic coupling remains. In this configuration, the adjustment of the second threaded device selectively moves a second end of the magnet relative to the pole such that magnetic coupling remains.

Yet further, as described more fully herein, the pole of the first assembly is not used to secure the housing to the base plate and the pickup is assembled independent of attachment to a musical instrument body.

Top Mounted Magnet Method

A method of assembling a pickup for an electrical, stringed musical instrument, is further provided. The method comprises constructing a first assembly. The first assembly is created by providing a base plate, and assembling a pole to the base plate such that the pole extends outward from a face of the base plate. The method also includes wrapping a coil of wire having a first coil end and a second coil end around the pole, such that when the pole is assembled to the base plate, the coil of wire above the base plate. Also, the method comprises attaching a first lead wire to the first coil end, and attaching a second lead wire to the second coil end. The first assembly can include any additional structures or any implementations as set out more fully herein with regard to the FIGURES.

The method also includes constructing a second assembly comprising a housing, positioning the magnet over the top of the first assembly such that the pole of the first assembly is in magnetic cooperation with the magnet, and attaching the housing of the second assembly to the top of the first assembly such that the magnet is therebetween. Again, any construction techniques set out more fully herein can be utilized. For instance, the magnet can be seated in a magnet well in the housing of the second assembly. Alternatively, the magnet can be seated in a magnet will in a top plate of the first assembly.

As such, the second assembly attaches to and detaches from the first assembly, thus exposing the magnet for a changeover to a different magnet, independently of any electrical connections made by the first lead wire and the second lead wire. Also, the second assembly, including the magnet are removable from the first assembly without removing the first assembly from the electrical, stringed musical instrument. Yet further, the second assembly, including the magnet are removable from the first assembly without removing strings or other hardware of the electrical, stringed musical instrument.

The method can further comprise constructing a plurality of first assemblies such that the first assemblies differ in at least one of: the material selected for the pole, the wire gauge, and the number of turns in the coil of wire and constructing a plurality of second assemblies such that the second assemblies differ in the configuration of the magnet.

The method may further comprise constructing the plurality of first assemblies independently of the construction of the plurality of second assemblies and assembling pickups by mating a selected one of the plurality of first assemblies to a selected one of the plurality of second assemblies to obtain desired electrical characteristics.

The method can further optionally comprises changing the magnet with another magnet having different magnetic properties to change the performance of the pickup when the pickup is installed in a musical instrument, without disturbing electrical wiring of the pickup to other electronics in a corresponding instrument.

Yet further, the method may optionally comprise installing a field adjusting coil by installing a first spring between the housing and the top plate proximate to the first fastener, and installing a second spring between the housing and the top plate proximate to the second fastener, such that when the first assembly is assembled with the second assembly, adjustment of the field-adjusting control adjusts a distance of the magnet from the pole.

The method may still further optionally comprise potting the first assembly but not the second assembly.

The method can yet further comprise providing the base plate as a non-conductive bobbin, passing the pole through the bobbin, and wrapping the coil around the pole, e.g., as set out in greater detail herein.

Miscellaneous

Traditionally, pickups provide either no adjustability, or very minor adjustability (e.g., where the pole is implemented with adjustment screws). However, for drastic changes, one is left with swapping out one pickup for another. Moreover, most pickups have exposed wires and are delicate, thus posing the risk of damage to the pickup. The prospect of damaging a pickup makes swapping pickups more difficult and time consuming. However, by utilizing the changeable magnet assembly described herein, both a manufacturer and the consumer have the benefit of being able to drastically alter the tonal qualities of a pickup, and have the ability to customize the pickup's performance. Additionally, the strain relief and protective wrapping about the coil of wire makes the pickup of the present disclosure more durable than traditional pickups, thus easing experimentation with magnet configurations to find an optimal musical result from the pickup installed in a corresponding stringed musical instrument.

By using fewer parts than traditional pickup designs, the assembly and winding process is eased and can be accomplished in shorter time and at lower cost. An additional benefit is that there are no vulnerable exposed coil wires, thus improving reliability and reducing customer returns. Moreover, the first assembly 102 and the second assembly 104 can be sold separately, mixed and matched, etc, to have numerous customization options. For instance, several models of first assembly 102 can be generated, with different wires, number of turns, winding patterns, poles, pole types, etc. Also, several different models of the second assembly 104 can be created, e.g., using different magnets 140 etc. By mixing and matching variations of the first assembly 102 with the second assembly, a vast array of options can be made available for experimentation and customization.

Also, by utilizing a top plate 120, the appearance of the pickup can be changed by changing out the top plate 120, such as when manufacturing the first assembly 102. Thus for instance, further customization can be realized by using wood, plastic, stone, or other non-conductive material to alter the aesthetics of the pickup.

Although described herein in the context of a single coil pickup, it is to be readily understood that the above-described techniques can be applied to humbucker pickups and other desired configurations that use one or more coils, sets of magnets, poles or combinations thereof.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure.

Having thus described the disclosure of the present application in detail and by reference to embodiments thereof, it will be apparent that modifications and variations are pos-sible without departing from the scope of the disclosure defined in the appended claims.

What is claimed is:

1. A pickup for an electrical, stringed musical instrument, comprising:

a first assembly having:

a base plate;

a pole that extends from the base plate;

a coil of wire having a first coil end and a second coil end, where the coil of wire is wrapped around the pole above the base plate;

a first lead wire attached to the first coil end; and a second lead wire attached to the second coil end; and a housing that is user attachable to, and detachable from, the first assembly independently of any electrical connections made by the first lead wire and the second lead wire to electronics of the electrical, stringed musical instrument; and a magnet seated in cooperation with the housing;

wherein:

the housing is user attachable to a top of the first assembly such that the magnet is situated between strings of the electrical, stringed musical instrument, and the pole of the first assembly;

the housing attaches to and detaches from the first assembly such that when attached, the pole of the first assembly is in magnetic cooperation with the magnet;

the housing is removable from the first assembly without removing the first assembly from the electrical, stringed musical instrument; and the housing is removable from the first assembly without removing strings or other hardware of the electrical, stringed musical instrument.

2. The pickup of claim 1, wherein:

the pole is secured between the base plate and a top plate of the first assembly such that the pole is flush with a top surface of the top plate; and the housing is temporarily secured to the top plate by at least one fastener such that the magnet is in cooperation with the pole.

3. The pickup of claim 1, wherein:

the housing comprises a magnet well; and the magnet is seated in the magnet well.

4. The pickup of claim 1, wherein:

the first assembly further comprises a top plate having a well therein;

the magnet is seated within the well on the top plate.

5. The pickup of claim 1 further comprising:

a second housing having a magnet well therein; and a second magnet mounted in the magnet well of the second housing;

wherein:

the second housing is attached to the first assembly opposite the first housing.

6. The pickup of claim 1, wherein:

the pole comprises a select one of: a blade, at least one slug, at least one individual threaded pole piece, and a combination thereof.

7. The pickup of claim 1, further comprising:

a non-magnetic spacer between the housing and the top plate of the first assembly.

8. The pickup of claim 1, wherein:

the pole of the first assembly is not used to secure the housing to the base plate; and the pickup is assembled independent of attachment to a musical instrument body.

9. The pickup of claim 1 further comprising:

a field-adjusting control that is user adjustable such that when the first assembly is assembled with the second assembly, adjustment of the field-adjusting control adjusts a distance of the magnet from the pole.

10. The pickup of claim 9, wherein:

the field-adjusting control comprises:

a first threaded device that extends into the first assembly proximate to a first end; and a second threaded device that extends into the first assembly proximate to a second end opposite the first end;

where adjustment of the first threaded device selectively moves a first end of the magnet relative to the pole such that magnetic coupling remains; and adjustment of the second threaded device selectively moves a second end of the magnet relative to the pole such that magnetic coupling remains.

11. A method of assembling a pickup for an electrical, stringed musical instrument, comprising:

constructing a first assembly by:

providing a base plate;

assembling a pole to the base plate such that the pole extends outward from a face of the base plate;

wrapping a coil of wire having a first coil end and a second coil end around the pole, such that when the pole is assembled to the base plate, the coil of wire above the base plate;

attaching a first lead wire to the first coil end; and attaching a second lead wire to the second coil end; and constructing a second assembly comprising a housing;

positioning the magnet over the top of the first assembly such that the pole of the first assembly is in magnetic cooperation with the magnet; and attaching the housing of the second assembly to the top of the first assembly such that the magnet is therebetween;

wherein:

the second assembly attaches to and detaches from the first assembly, thus exposing the magnet for a changeover to a different magnet, independently of any electrical connections made by the first lead wire and the second lead wire;

the second assembly and the magnet are removable from the first assembly without removing the first assembly from the electrical, stringed musical instrument; and the second assembly and the magnet are removable from the first assembly without removing strings or other hardware of the electrical, stringed musical instrument.

12. The method of claim 11 further comprising:

constructing a plurality of first assemblies such that the first assemblies differ in at least one of: the material selected for the pole, the wire gauge, and the number of turns in the coil of wire; and constructing a plurality of second assemblies such that the second assemblies differ in the configuration of the magnet.

13. The method of claim 12 further comprising:

constructing the plurality of first assemblies independently of the construction of the plurality of second assemblies; and assembling pickups by mating a selected one of the plurality of first assemblies to a selected one of the plurality of second assemblies to obtain desired electrical characteristics.

14. The method of claim 11 further comprising:

changing the magnet with another magnet having different magnetic properties to change the performance of the pickup when the pickup is installed in a musical instrument, without disturbing electrical wiring of the pickup to other electronics in a corresponding instrument.

15. The method of claim 11 further comprising:

providing the base plate as a non-conductive bobbin;

passing the pole through the bobbin; and wrapping the coil around the pole.

16. The method of claim 11 further comprising:

wrapping an outer layer over the coil, the outer layer comprised of at least one of a length of wire, cloth, or tape.

17. The method of claim 11 further comprising:

securing the housing of the second assembly to the top plate of the first assembly independently of screws, using a select one of clips, snaps, hook and loop fastener, and magnets and the first fastener and the second fastener.

18. The method of claim 11 further comprising:

installing a field adjusting coil by:

installing a first spring between the housing and the top plate proximate to the first fastener; and installing a second spring between the housing and the top plate proximate to the second fastener;

wherein:

when the first assembly is assembled with the second assembly, adjustment of the field-adjusting control adjusts a distance of the magnet from the pole.

19. The method of claim 11 further comprising:

potting the first assembly but not the second assembly.

* * * * *